US009664447B2

(12) United States Patent
Kohno et al.

(10) Patent No.: US 9,664,447 B2
(45) Date of Patent: May 30, 2017

(54) FIBROUS HEAT-INSULATING BLOCK AND METHOD FOR LINING HEATED FURNACE-SURFACE USING SAME

(75) Inventors: Kohji Kohno, Tokyo (JP); Motokuni Itakusu, Tokyo (JP); Masaharu Sato, Tokyo (JP); Takuo Uehara, Tokyo (JP); Yoshitsugu Okanaka, Tokyo (JP); Tomonobu Shiraishi, Tokyo (JP); Kenji Goto, Tokyo (JP); Sho Yamanaka, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 13/638,499

(22) PCT Filed: Mar. 31, 2011

(86) PCT No.: PCT/JP2011/058744
§ 371 (c)(1),
(2), (4) Date: Sep. 28, 2012

(87) PCT Pub. No.: WO2011/126061
PCT Pub. Date: Oct. 13, 2011

(65) Prior Publication Data

US 2013/0019553 A1 Jan. 24, 2013

(30) Foreign Application Priority Data

Mar. 31, 2010 (JP) ..... 2010-080666

(51) Int. Cl.
*F27D 1/00* (2006.01)
*F27D 1/16* (2006.01)

(52) U.S. Cl.
CPC ..... *F27D 1/0009* (2013.01); *F27D 1/0013* (2013.01); *F27D 1/0016* (2013.01); *F27D 1/1621* (2013.01)

(58) Field of Classification Search
USPC ..... 52/506.02, 747.13
See application file for complete search history.

(56) References Cited

U.S. PATENT DOCUMENTS 4,516,374 A * 5/1985 Finney ..... 52/404.4
6,782,922 B1 * 8/2004 Migliorini et al. ..... 138/149

FOREIGN PATENT DOCUMENTS

JP 53-18609 A 2/1978
JP 59-21981 A 2/1984
(Continued)

OTHER PUBLICATIONS

International Search Report issued in PCT/JP2011/058744 mailed Jul. 5, 2011.
(Continued)

*Primary Examiner* — Patrick Maestri
(74) *Attorney, Agent, or Firm* — Birch, Stewart, Kolasch & Birch, LLP

(57) ABSTRACT

Disclosed are a fibrous insulation block which can improve work efficiency of lining construction in various types of refractory furnace in iron works, and a construction method for a heated furnace-surface lining using the same. Specifically disclosed is a fibrous insulation block which comprises: a unit block (2) formed by laminating fibrous insulation blankets under pressure; a packing material (3) which has a pressing surface abutting section (5) covering at least a part of each pressing surface (2*a*, 2*b*) which are the side surfaces of the unit block in the direction in which the blankets are laminated, and a heating surface protection section (6) connected to the pressing surface abutting section so as to cover at least a part of a heating surface (2*c*) of the unit block, and in which a boundary section (7) between the pressing surface abutting section and the heating surface protection section covers an angle section formed by the pressing surfaces and the heating surface of the unit block;
(Continued)

and a binding band (4) which maintains the shape of the unit block (2) using the packing material (3). The heating surface protection section (6) of the packing material (3) can be moved by the removal of the binding band and disposed on the same plane as the pressing surface abutting section, and has handhold sections (10) provided therein.

8 Claims, 7 Drawing Sheets

(56) References Cited

FOREIGN PATENT DOCUMENTS

| | | | |
|---|---|---|---|
| JP | 63-256575 | A | 10/1988 |
| JP | 64-90989 | A | 4/1989 |
| JP | 1-70097 | U | 5/1989 |
| JP | 5-71870 | B2 | 10/1993 |
| JP | 6-22895 | U | 3/1994 |
| JP | 10-288467 | A | 10/1998 |

OTHER PUBLICATIONS

Shin-Nippon Thermal Ceramics Corporation, "'S Fiber SC' of fireproof and heat-insulating fiber for high temperature uses and ceramic fiber products manufactured by Shin-Nippon Thermal Ceramics Corporation", Aug. 2007, 32 pages.

The Energy Conservation Center, "Ceramic Fiber and Heat-Insulating Application", Edited by Ceramic Fiber and Heat-Insulating Application Editorial board, issued by The Energy Conservation Center, pp. 25-32 and 57-80.

English language translation of Japanese Application No. 63-256575, published Oct. 24, 1988.

* cited by examiner (a)

(b)

FIBROUS HEAT-INSULATING BLOCK AND METHOD FOR LINING HEATED FURNACE-SURFACE USING SAME

TECHNICAL FIELD

The present invention relates to a fibrous heat-insulating block used in a fireproof heat-insulating lining applied to surfaces heated during operation of various fireproof furnaces including heating furnaces, soaking furnaces, heat treat furnaces, which are used in pig-iron making, steel making and rolling steps in steel plants, for example, surfaces of furnace walls, furnace lids covers, ceilings and skid-posts (hereinafter also referred to as "heated furnace-surfaces"), and a lining method for the heated furnace-surface using the fibrous heat-insulating block and a fibrous heat-insulating block packing material.

BACKGROUND ART

In recent years, for energy saving and heat insulation, fibrous heat-insulating materials, such as ceramic fibers, have been used for lining of furnace walls in various kiln equipment, such as heating furnaces and the like. The fibrous heat-insulating material has low thermal conductivity, is light-weight and has a small bulk specific gravity, and thus is excellent in thermal inertia, which advantageously enables a decrease in cooling and heating time in the furnace. For this reason, the fibrous heat-insulating material is used as a main lining material in a region where it is not in contact with a scale or melted metal in the heating furnace and the like.

Describing ceramic fiber (CF) as a typical fibrous heat-insulating material as an example, conventionally, when various furnaces are lined by using the ceramic fiber, a paper lining method of stacking a ceramic fiber blanket (CF blanket) formed by shaping the ceramic fiber into a blanket-like material on a support pin welded to a heated surface of a shell (furnace wall) has been adopted. However, the CF blanket have following problems: contraction in the thickness direction at elevated temperatures is large, a fitting such as the support pin is exposed in the furnace and thus, is susceptible to oxidation damage, and lining is relatively difficult since the CF blanket has a large area and a gap may be formed between layers thereof.

Thus, in recent years, a unit block obtained by folding a band-like CF blanket to have a predetermined length and stacking the layers of the CF blanket under pressure, or stacking a plurality of CF blanket pieces cut from the CF blanket to have a predetermined size, and forming the stacked layers of the CF blanket or CF blanket pieces into the shape of a block by sewing, bonding, use of built-in fitting or the like has been adopted. The unit block is used for lining in the state where its compressed shape is maintained by using a predetermined packing material and a binding band (see Non Patent Literatures 1 and 2).

For example, a CF block 31 as shown in FIGS. 7(*a*) and 7(*b*) is known as such CF block. The CF block 31 is manufactured by alternately folding a band-like CF blanket to have a predetermined length while making mountain folds and valley folds and stacking layers of the CF blanket under pressure to form a unit block 32 measuring about 300 mm×300 mm×300 mm, for example. The unit block 32 has a pair of pressed surfaces 32*a* that are pressed to finally from a block material used for lining, and a heated surface 32*b* heated in the lined state in the furnace. A block 32 is covered with a packing material 33 formed of a pair of packing members 33*a*, 33*b*, from the right and left pressed surfaces 32*a* to the heated surface 32*b* so as to protect each corner where the pressed surface 32*a* is in contact with the heated surface 32*b*, and is bound with two binding bands 34 via the packing material 33. The packing members 33*a*, 33*b* configuring the packing material 33 each consists of a pressed surface contact part 35 covering the pressed surface 32*a* of the block 32, a heated surface protection part 36 covering a part of the heated surface 32*b* for protection, and a bent part 37 formed between the pressed surface contact part 35 and the heated surface protection part 36. Reference numeral 38 in FIG. 7(*b*) shows a fitting for attaching the unit block 32 to the shell (furnace wall) at lining with a fibrous heat-insulating block 31. Reference numeral 39 in FIG. 7(*a*) is a paper tube guide pipe for operating the fitting 38 lining the fibrous heat-insulating block 31.

The CF blanket includes well-intertwined fibers and therefore, has a small heating contraction factor in its longitudinal direction and a relatively large heating contraction factor in its thickness direction. For this reason, as distinct from paper lining that uses a surface of the CF blanket as a heated surface and prevents heat transfer due to the thickness of the CF blanket, the lining using the CF block can orient its longitudinal direction to a main heat transfer direction, resulting in a high heat-insulating efficiency. Moreover, in the CF block, since the fitting (built-in fitting) for holding the shape of the CF block is inserted into the unit block, and the fitting such as a channel for attaching the unit block to the shell (see the reference numeral 38 in FIG. 7(*b*)) is exposed only on a cool surface of lining (surface on the opposite side to the heated surface), damage due to oxidation of the fitting can be suppressed, leading to a dramatic increase in life. In addition, since the CF block is provided with the guide pipe for bonding a support bolt welded to the shell to the unit block with a nut (see the reference numeral 39 in FIG. 7(*a*)), an attachment operation is easy. Further, since the CF block can be made to have easily-handled size, the workability of lining application can be greatly improved.

In lining using the CF block, the unit block formed by folding and stacking the layers of the CF blanket or stacking the CF blanket pieces of predetermined shape is used as one unit. In order to keep the shape of the unit block until lining and improve handleability until lining, the CF block is fixed to have predetermined size by placing a (paper) cardboard as the packing material on the pressed surface vertical to a stacking direction of the unit blanket and compressing them in the stacking direction and then, binding them with the binding band. In the case where the CF blanket is folded to form the CF block, the packing material to be used therefor protects fibers on the pressed surfaces 32*a* of the unit block 32, corners at boundaries between the pressed surfaces 32*a* and the heated surface 32*b* and the heated surface by extending the heated surface protection part 36 from the pressed surface contact part 35 covering the pressed surfaces 32*a* of the unit block 32 to the heated surface 32*b* as shown in FIGS. 7(*a*) and 7(*b*) such that mountain folds of the CF blanket are not damaged by fastening of the binding band. Generally, the heated surface protection part 36 is not in contact with the mounting folds of the CF blanket at its end, and is located at a position beyond the second mountain fold from the corners at the boundaries between the pressed surfaces 32*a* and the heated surface 32*b*, for the purpose of lower cost.

When the inner surface of the furnace wall is lined with the CF block, it is important to prevent the occurrence of a gap at a joint between the adjacent CF blocks. In the unit block of the CF block, the layers of the CF blanket are stacked and compressed between the pair of pressed surfaces under pressure. For this reason, the CF block has a little restoring force in the direction orthogonal to the CF blanket stacking direction, but has a restoring force in the stacking direction. Thus, some lining methods using the restoring force applied in the CF block stacking direction have been proposed.

For example, Patent Literatures 1 proposes a so-called checker method of arranging the cool surface (surface on the opposite side to the heated surface) on which the fitting such as the channel (see the member represented by the reference numeral 38 in FIG. 7(*b*)) is mounted toward an inner surface of the furnace wall, and alternatively lining the unit blocks while rotating by 90 degrees when viewed from the heated surface such that the CF blanket stacking directions of the adjacent unit blocks do not match each other. According to the checker method, by the restoring force in the CF blanket stacking direction, a pressing force is applied to each unit block from the direction orthogonal to the CF blanket stacking direction (direction in which the unit block itself exerts the restoring force), thereby suppressing the occurrence of a gap at the joint between the unit blocks. However, according to the checker method, when some unit blocks are displaced from each other, a gap at the joint between the adjacent unit blocks may occur. A triangular joint may be formed especially in a region where the four corners of the adjacent unit blocks gather, as it is difficult to concentrate the four unit block corners at one point. To supplement the joint, the joint is filled by inserting a fold into the gap at the joint, or filling a bulky ceramic fiber into the triangular joint.

In addition to the checker method, for example, Patent Literatures 2 proposes a so-called soldier method of arranging the plurality of unit blocks in a line such that their pressed surfaces are faced each other to form a unit block arrangement and inserting the CF blanket into a joint formed between rows of the unit block arrangement to fill the joint.

Patent Literature 3 describes a compression module that enables application of the CF blanket in its compressed state, and can prevent deformation or local destruction of the CF blanket to extend its durable lifetime. As shown in FIGS. 8(*a*) to 8(*c*), the compression module 41 in Patent Literatures 3 is manufactured by sandwiching a unit block formed of a plurality of stacked layers of the CF blanket 42 measuring 300 mm×300 mm between fish plates 44 made of a rigid material and compressing the layers, and then, binding the layers with a plurality of bands 45. The fish plates 44 in FIGS. 8(*a*) and 8(*c*) each has parts protruded from a heated surface 46 from the module 41, the fish plates in FIG. 8(*a*) each includes a handhold part 48 formed by bending a part of the protruded part toward the heated surface, and the fish plates in FIG. 8(*c*) each has a hole 49 in the protruded part as a handhold part. The fish plates in FIG. 8(*b*) each includes the handhold part 48 formed by inwardly bending a part of an end of the compression module 41 on the side of the heated surface 46.

PRIOR ART LITERATURES

Patent Literature

Patent Literatures 1: JP 53-18609 A
Patent Literatures 2: JP 5-71870 B
Patent Literatures 3: JP 6-22895 U

Non Patent Literature

Non Patent Literatures 1: A catalog "S fiber SC" of fireproof and heat-insulating fiber for high temperature uses and ceramic fiber products manufactured by Shin-Nippon Thermal Ceramics Corporation Non Patent Literatures 2: A new version "Ceramic Fiber and Heat-Insulating Application" edited by "Ceramic Fiber and Heat-Insulating Application" editorial board and issued by The Energy Conservation Center, pp 26-29, 63-79

DISCLOSURE OF THE INVENTION

Problems to be Solved by the Invention

For example, in the lining application according to the above-mentioned checker method, after the unit blocks are attached to the inner surface of the furnace wall with the fitting such as the channel, the binding band and the packing material, which are used for packing these unit blocks (for keeping the compressed state), must be pulled out. In the pulling-out operation of the binding band and the packing material, first, the binding band fixing each of the adjacent unit blocks is cut and then, pulled out. Then, a gap between the adjacent unit blocks is filled with the CF blanket by the restoring force of the CF blanket configuring each unit block. At this time, the packing material is sandwiched between the adjacent unit blocks under pressure and still remains. Accordingly, next, the packing material is manually pulled out with a nipper, for example. In the case of the unit block measuring 300 mm×300 mm×300 mm, since the CF blanket is pressed with a compression force as high as about 0.5 MPa, the pulling-out operation of the packing material requires heavy physical work and its operating efficiency is poor.

Moreover, with the packing material made of paper, in some cases, the packing material breaks during puling-out and remains between the adjacent unit blocks, and cannot be collected. When the packing material remains between the unit blocks, even the joint filling operation cannot be performed. For this reason, to remove the remaining packing material, it is necessary to heat the inside of the furnace to burn down the packing material, which contributes to a large loss in operating time and costs in the whole furnace construction process. Further, the fact that the packing material cannot be collected (reused) from between the unit blocks is also environmentally undesirable.

With the packing material made of the rigid material (an iron plate, an aluminum plate, an aluminum alloy plate or a plastic plate) as described in Patent Literatures 3, breaking due to pulling-out is avoided. However, with the unit block (compression module) in Patent Literatures 3 shown in FIGS. 8(*a*), 8(*c*), since a part of the packing material (fish plates 44) that compresses the stacked layers of the CF blanket 42 is protruded from the heated surfaces 46 of the module 41, the dimensional accuracy of the module 41 may be lowered by excessively fastening the module 41 on the side of the heated surfaces 46 at binding with the bands 45. Further, the heated surfaces 46 of the module 41 are not protected at all and thus, may be damaged during storage, transportation and lining. With the unit block (compression module) in Patent Literatures 3 shown in FIG. 8(*b*), although excessive local fastening with the bands 45 is prevented, when the fish plates are pulled out, some kind of tool must be forcibly inserted between the heated surface 46 of the module 41 and the handhold part 48 of the fish plates 44, which can easily damage the heated surface 46. Moreover, since the heated surface 46 is exposed, except for the handhold parts 48, corners of the unit block can be also easily damaged especially at binding with the bands 45.

Therefore, an object of the present invention is to provide a fibrous heat-insulating block capable of reducing the operator's load during pulling out the packing material, collecting the packing material without breaking and repeatedly using the collected packing material, and eliminating any excessive operation such as removal of the packing material remaining between the unit blocks to improve the operating efficiency of lining.

Another object of the present invention is to provide a furnace wall lining method that uses such a fibrous heat-insulating block and has high operating efficiency.

Means to Solve the Problems

The present invention solves the above-mentioned problems with the following constitutions and provides a fibrous heat-insulating block, a lining method of a heated furnace-surface by using the fibrous heat-insulating block, and a fibrous heat-insulating block packing material.

[1] A fibrous heat-insulating block used for lining a heated furnace-surface, the fibrous heat-insulating block including:

a unit block formed by stacking layers of fibrous heat-insulating blanket under pressure, the unit block being used as a unit for lining application, a packing material including pressed surface contact parts each covering at least a part of each of pressed surfaces as side surfaces of the unit block in a blanket stacking direction, and heated surface protection parts each being connected to the heated surface contact part and covering at least a part of a heated surface of the fibrous heat-insulating block heated in the state where a furnace is lined therewith, wherein a boundary between the pressed surface contact part and the heated surface protection part covers a corner formed by the pressed surface and the heated surface of the unit block; and a binding band keeping the shape of the unit block via the packing materials, wherein the heated surface protection part of the packing material can be moved by removing the binding band and arranged on the same plane as the pressed surface contact part, and the heated surface protection part of the packing material is provided with a handhold part.

[2] The fibrous heat-insulating block according to above [1], wherein the packing material is constituted of a pair of packing members arranged on the side surfaces of the unit block in the blanket stacking direction, the packing member being constituted of the pressed surface contact part, the heated surface protection part connected thereto, and the boundary.

[3] The fibrous heat-insulating block according to above [2], wherein the packing member is bendable at the boundary.

[4] The fibrous heat-insulating block according to above [2] or [3], wherein the packing member is an integrated item, and has a notch along the boundary.

[5] The fibrous heat-insulating block according to above [2] or [3], wherein the pressed surface contact part and the heated surface protection part of the packing material are individually formed, and are connected to each other with a hinge or a sheet connected to the two.

[6] The fibrous heat-insulating block according to above [2] or [3], wherein when the binding band is removed, the packing member is separated from the heated surface protection part due to elasticity of a material itself constituting the packing member.

[7] The fibrous heat-insulating block according to any one of above [1] to [6], wherein the packing material is made of a synthetic resin material.

[8] The fibrous heat-insulating block according to above [7], wherein the synthetic resin material is a sheet or corrugated plastic cardboard that is made of hard polyvinyl chloride, polypropylene, polycarbonate or polystyrene.

[9] The fibrous heat-insulating block according to any one of above [1] to [8], wherein the handhold part is manufactured as an eyelet hole, a ring or a hook-like engaging part.

[10] The fibrous heat-insulating block according to any one of above [2] to [9], wherein the heated surface protection part of each of the pair of packing members has a pair of the handhold parts.

[11] The fibrous heat-insulating block according to any one of above [2] to [10], wherein the unit block is a cube or rectangular parallelepiped having a side of 200 to 400 mm, a tensile strength of the packing member is 5 to 90 MPa, and a static friction coefficient of the packing member with the fibrous heat-insulating material is 0.1 to 1.

[12] A method for lining a heated furnace-surface including:

arranging a plurality of fibrous heat-insulating blocks at predetermined places of the heated furnace-surface, the fibrous heat-insulating blocks each including:

a unit block formed by stacking layers of fibrous heat-insulating blanket under pressure, the unit block being used as a unit for lining, a packing material including pressed surface contact parts each covering at least a part of each of pressed surfaces as side surfaces of the unit block in a blanket stacking direction, and heated surface protection parts covering a heated surface of the fibrous heat-insulating block heated in the state where a furnace is lined therewith, and a binding band keeping the shape of the unit block via the packing material; and after cutting and removal of the binding band of the fibrous heat-insulating block, pulling out the packing material remaining between the adjacent fibrous heat-insulating blocks, thereby putting the adjacent fibrous heat-insulating blocks into close contact with each other, wherein the fibrous heat-insulating block according to any one of above [1] to [11] is used as the fibrous heat-insulating block.

[13] The method for lining a heated furnace-surface according to above [12], wherein when the packing material remaining between the adjacent fibrous heat-insulating blocks is pulled out, a pulling jig is used, the pulling jid including a leg having one end in contact with the unit block substantially vertically thereto, a movable part that is detachably engaged with a handhold part provided in the packing material and moves along the leg, and a towing means that is provided at the other end of the leg and moves the movable part along the leg.

[14] The method for lining a heated furnace-surface according to above [13], wherein the towing means is an electric reeler including a motor as its driving means and a towing wire, one end of which is coupled to the movable part.

Effects of the Invention

According to the present invention, in lining of the heated furnace-surface by means of the fibrous heat-insulating block, since the heated surface protection part of the packing material is made movable by removal of the binding band, the direction of applying a force to the heated surface protection part in order to pull out the packing material sandwiched between the adjacent unit blocks can be made equal to the direction of pulling the packing material. The heated surface protection part is provided with the handhold part for pulling-out. By the combined effect of these, according to the present invention, the packing material sandwiched between the adjacent unit blocks can be easily collected, and breaking and deformation of the packing material when pulling-out can be prevented. For this reason, the conventional frequently-performed operation of removing the broken packing material remaining between the adjacent blocks is not required, resulting in that the operating efficiency of lining of the furnace wall can be improved, and the packing material can be repeatedly used. Further, a jig can be used in the pulling-out operation of the packing material for lining, thereby greatly reducing time necessary for the pulling-out operation of the packing material.

MODE TO CARRY OUT THE INVENTION

The present invention will be described below in detail based on an example of an embodiment shown in appended figures.

Figure 1:
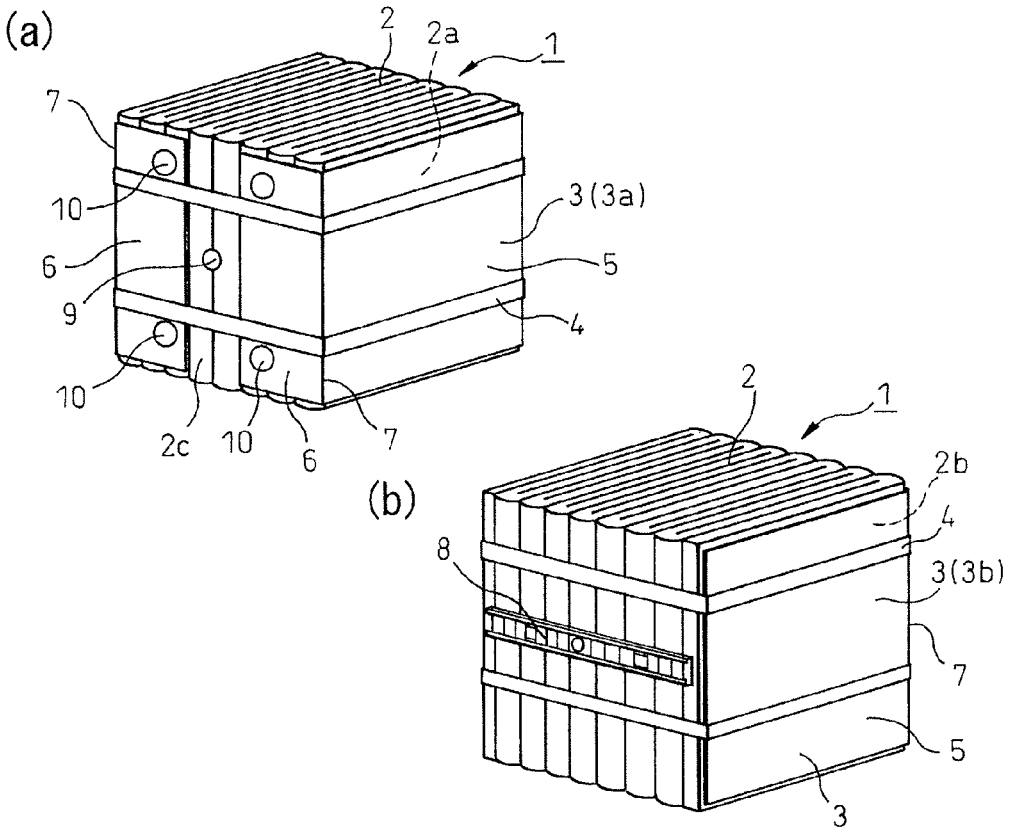
FIG. 1 is a perspective view illustrating a fibrous heat-insulating block in accordance with an embodiment of the present invention, in which FIG. 1(*a*) is a perspective view when viewed from a front surface (heated surface) and FIG. 1(*b*) is a perspective view when viewed from a back surface (cool surface).

FIGS. 1(*a*) and 1(*b*) show an example of a fibrous heat-insulating block according to the present invention. The fibrous heat-insulating material used in the fibrous heat-insulating block according to the present invention is a block formed by using a heat-insulating material made of a fibrous material, and is used for lining of the heated furnace-surface. The "heated furnace-surface" as used herein refers to surfaces heated during operation of various fireproof furnaces including heating furnaces, soaking furnaces, heat treat furnaces, which are used in pig-iron making, steel making and rolling steps in steel plants, for example, surfaces of furnace walls, furnace lids, covers, ceilings and skid-posts. According to the present invention, a blanket-like fibrous heat-insulating materials is folded and stacked under pressure to form a unit block. Typical examples of the fibrous heat-insulating material include ceramic fibers (artificial inorganic fibers containing alumina ($Al_2O_3$) and silica ($SiO_2$) as main components), and inorganic fibrous materials such as glass wool and rock wool. The ceramic fiber (CF) will be used below as an example of the fibrous heat-insulating material.

Figure 7:
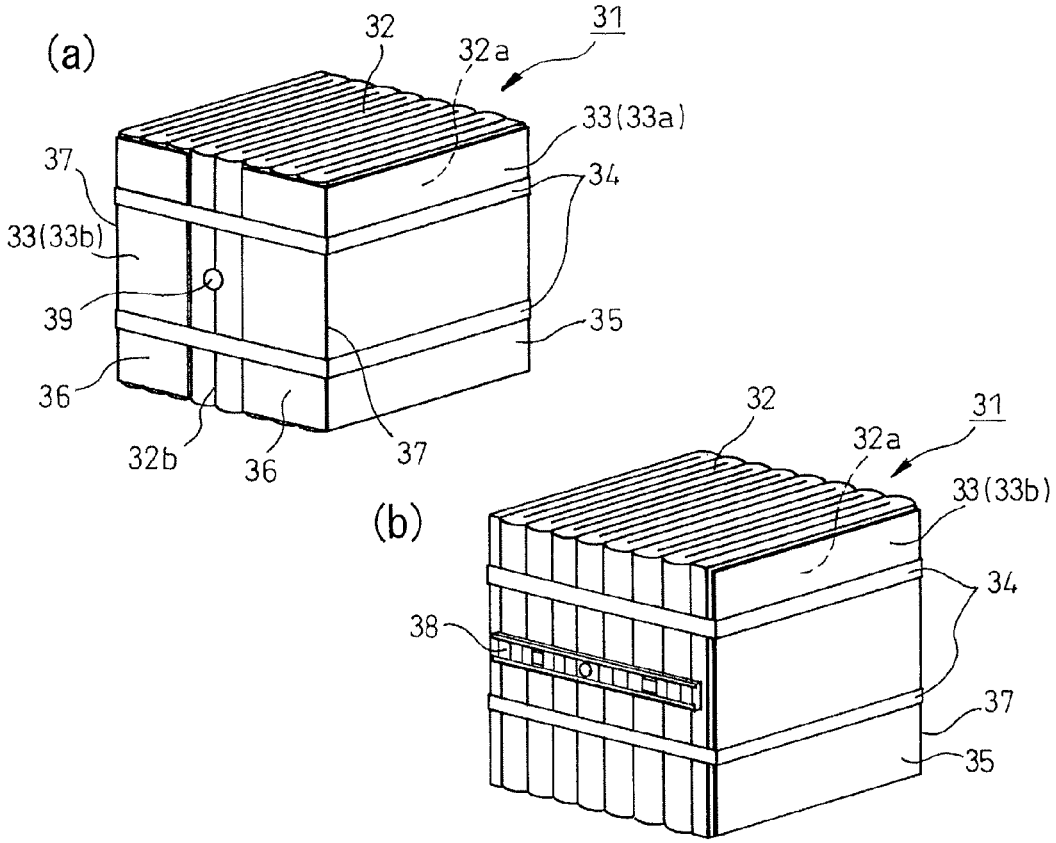
Fig.7 PRIOR ART
FIG. 7 is a perspective view illustrating a conventional fibrous heat-insulating block, in which FIG. 7(*a*) is a perspective view when viewed from a front surface (heated surface) and FIG. 7(*b*) is a perspective view when viewed from a back surface (cool surface).

The fibrous heat-insulating block 1 according to the present invention shown in FIGS. 1(*a*) and 1(*b*) has a configuration similar to that of the above-mentioned fibrous heat-insulating block shown in FIGS. 7(*a*) and 7(*b*). Specifically, the fibrous heat-insulating block 1 includes a unit block 2 formed by alternately folding a band-like CF blanket to have a predetermined length while making mountain folds and making valley folds and stacking the layers under pressure, packing materials 3 each having a pressed surface contact part 5 covering pressed surfaces 2*a*, 2*b* as side surfaces of the unit block 2 in a blanket stacking direction and a heated surface protection part 6 that is connected to the heated surface contact part 5 and covering a heated surface 2*c* heated in the state where the inside of a furnace is lined by the fibrous heat-insulating block, a boundary between the pressed surface contact part 5 and the heated surface protection part 6 covering corners formed by the pressed surfaces 2*a*, 2*b* and a heated surface 2*c* of the unit block 2, and binding bands 4 that binds the unit block 2 together with the packing materials 3 to keep the shape of the unit block 2. The heated surface protection part 6 of the packing material 3 is provided with handhold parts 10 used to pull out the packing material 3 sandwiched between the adjacent unit blocks 2 by removing the binding bands 4 after arrangement of the fibrous heat-insulating block 1 at a predetermined place at lining application. The fibrous heat-insulating block 1 is manufactured using the unit block 2 formed by, for example, alternately folding the CF blanket having a thickness of 25 mm to form 16 stacked layers and compressing the stacked layers into a block measuring 300 mm×300 mm×300 mm. Like the block according to the prior art described referring to FIGS. 7(*a*) and 7(*b*), the fibrous heat-insulating block 1 in FIGS. 1(*a*) and 1(*b*) includes a fitting 8 for attaching the unit block 2 to the heated furnace-surface at lining application (FIG. 1(*b*)), and a guide pipe 9 for operating the fitting 8 at lining application (FIG. 1(*a*)). The guide pipe 9 is formed of a paper tube, for example.

In the fibrous heat-insulating block 1 according to the present invention, when the packing material 3 between the adjacent blocks is pulled out by removing the binding bands 4 after arrangement of the plurality of fibrous heat-insulating blocks 1 at the predetermined place at lining application, the heated surface protection part 6 that is movable relative to the pressed surface contact part 5 of sandwiched packing members 3*a*, 3*b* can be arranged in the same plane as the pressed surface contact part 5. Thereby, the direction of a force applied to the packing members 3*a*, 3*b* in pulling-out thereof can be made equal to the direction of pulling out the pressed surface contact part, achieving easy pulling-out.

In the fibrous heat-insulating block 1 according to the present invention, as shown in FIG. 1(*a*), a boundary 7 between the pressed surface contact part 5 of each of the packing members 3*a*, 3*b* and the heated surface protection part 6 can protect a right or left corner of the heated surface 2*c* of the unit block 2.

In the fibrous heat-insulating block 1 in FIGS. 1(*a*) and 1(*b*), the packing material 3 consists of a pair of packing members 3*a*, 3*b* each having the pressed surface contact part 5 covering the almost whole of the pressed surface 2*a* (or 2*b*) and the heated surface protection part 6 covering a part of the heated surface 2*c*. Each of the packing members 3*a*, 3*b* is manufactured as an integrated item, and the boundary 7 is located between the pressed surface contact part 5 and the heated surface protection part 6. The heated surface protection part 6 of each of the packing members 3*a*, 3*b* is provided with a pair of eyelet holes as the handhold parts 10 for pulling out the packing material 3 sandwiched between the adjacent unit blocks 2 by removing the binding bands 4 after arrangement of the fibrous heat-insulating block 1 at the predetermined place at lining application. The handhold parts 10 are not limited to a pair of eyelet holes, and may be one detachably engaged with, for example, a hook-like engaging part (hook) of a movable part provided in a below-mentioned pulling jig for the packing material. For example, the handhold parts 10 may be a ring, a hook-like engaging part (hook) or the like, which is attached to an edge of a free end of the heated surface protection part 6.

In the fibrous heat-insulating block 1 in FIGS. 1(*a*) and 1(*b*), the pressed surface contact parts 5 of the packing material 3 are formed so as to cover the almost whole of the pressed surfaces 2*a*, 2*b* of the unit block 2. The pressed surface contact parts 5 may be formed so as to cover the whole of the pressed surfaces 2*a*, 2*b* of the unit block 2. However, in this case, when the fibrous heat-insulating blocks 1 are arranged at the predetermined place in the lining application, the ends of the pressed surface contact parts 5 of the adjacent blocks 1 may come into contact and interfere with each other, disturbing operations. Therefore, it is preferred that the pressed surface contact part 5, only partially covers each of the pressed surfaces 2*a*, 2*b* of the unit block 2 except for the ends thereof, as shown in FIGS. 1(*a*) and 1(*b*).

In the fibrous heat-insulating block 1 in FIGS. 1(*a*) and 1(*b*), the unit block 2 is formed by alternately folding the band-like CF blanket to have a predetermined length while making the mountain folds and making the valley folds to form stacked layers under pressure. However, formation of the unit block 2 is not limited to this, and a plurality of CF blanket pieces each having predetermined size may be cut from the CF blanket, and the pieces may be stacked under pressure to form the unit block 2.

Figure 3:
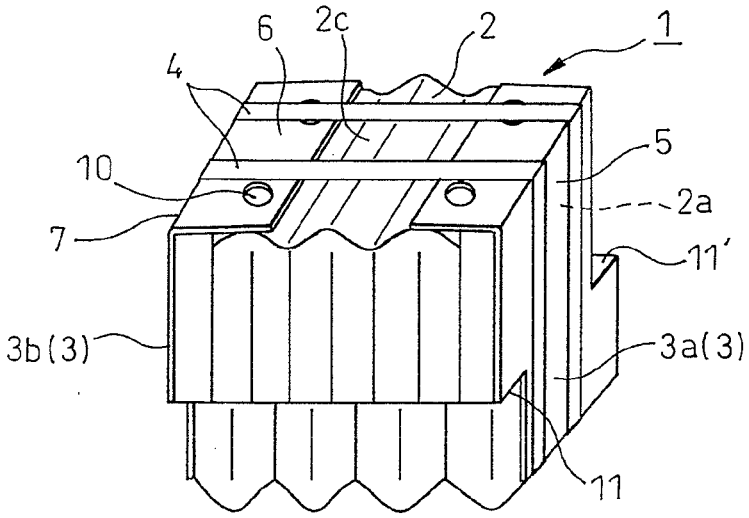
FIG. 3 is a perspective view illustrating a fibrous heat-insulating block in accordance with another embodiment of the present invention.

The shape of the unit block 2 is also not limited to a cube as shown in FIGS. 1(*a*) and 1(*b*). For example, as shown in FIG. 3, the unit block 2 may have a cut step 11 in a rear part on the side of the heated surface 2*c* and a cut step 11' in a front part on the side of the cool surface opposite to the heated surface 2*c*. Alternatively, the unit block may have various different shapes such as an L-type block applied at a corner of the furnace wall and a lintel block applied to a cylindrical member such as a skid post. Further, the size of the unit block 2 and the type of the CF fiber forming the unit block 2 are not specifically limited.

Figure 2:
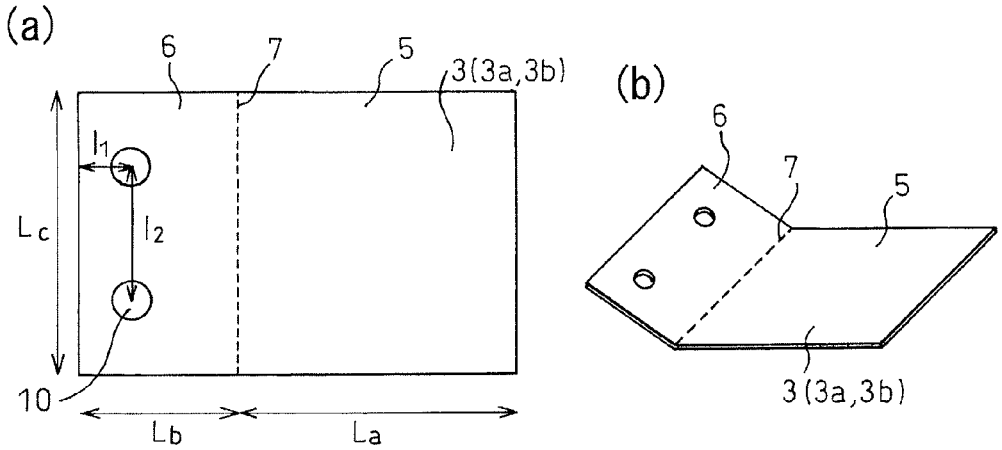
FIG. 2 is a view illustrating a packing material constituted of a pair of packing members used in the fibrous heat-insulating block in FIG. 1, in which FIG. 2(*a*) is a front view of the packing member, and FIG. 2(*b*) is a perspective view showing the bent packing member.

The packing material 3 consists of the pair of packing members 3*a*, 3*b*, and as shown in FIG. 2(*a*), the packing members 3*a*, 3*b* each has the pressed surface contact part 5, the heated surface protection part 6, and the boundary 7 located therebetween. The packing members 3*a*, 3*b* in FIG. 2(*a*) each is formed as an integrated item that can be bent at the boundary 7. FIG. 2(*b*) shows the packing members 3*a*, 3*b* bent at the boundary 7. In the fibrous heat-insulating block 1 illustrated in FIGS. 1(*a*) and 1(*b*), the packing material 3 allows the pressed surface contact part 5 to come into contact with the pressed surfaces 2*a*, 2*b* of the unit block 2, and the heated surface protection part 6 to be bent at the boundary 7 to come into contact with the heated surface 2*c* of the unit block 2, and is bound together with the unit block 2 by means of the binding bands 4 to keep the unit block 2 in the compressed state. In pulling out the packing material 3 from between the adjacent fibrous heat-insulating blocks 1 arranged at the predetermined place of the heated furnace-surface at lining application according to the checker method, when the binding bands 4 are cut and removed, the heated surface protection part 6 that is movable from the boundary 7 is liberated from binding and thus, can be freely separated from the heated surface 2*c* due to, for example, elasticity of the packing member itself. As shown in FIG. 2, the heated surface protection part 6 is provided with the pair of eyelet holes as the handhold part used in pulling out the packing material 3 from between the adjacent blocks.

For example, the packing material 3 consists of a pair of packing members 3*a*, 3*b* each having the rectangular, pressed surface contact part 5 of a size that is the same as or smaller than that of the pressed surface 2*a* of the unit block 2. For the size of the packing members 3*a*, 3*b*, it is preferred that dimensions La and Lc of the respective sides of the pressed surface contact part 5 each is in the range from 85 to 97% of the dimensions of a side of the pressed surface 2*a* of the unit block 2 (FIG. 1) (when the pressed surface of the unit block 2 is a square measuring 300 mm×300 mm, 255 to 291 mm). When the dimensions La and Lc of sides of the pressed surface contact part 5 each exceeds 97% of the dimensions of each side of the pressed surface 2*a* of the unit block 2, in the state where the unit blocks are arranged at the predetermined place of the heated furnace-surface, the packing members of the adjacent unit blocks interfere with each other, easily generating a triangular joint. On the contrary, when the dimensions La and Lc each is smaller than 85% of the dimension of each side of the pressed surface 2*a*, the pressing effect on the unit block 2 is impaired. More preferably, the dimensions La and Lc of sides of the pressed surface contact part 5 each is the range of 90 to 97% of the dimensions of each side of the pressed surface 2*a* of the unit block 2 (when the pressed surface of the unit block 2 is a square measuring 300 mm×300 mm, 270 to 291 mm).

The interference between the packing members of the adjacent unit blocks arranged at the predetermined place of the heated furnace-surface is caused by contact between the packing members of the adjacent unit blocks. Accordingly, to prevent such interference, the packing member may have such a dimension to generate a non-contact part corresponding to the thickness of the packing member at an end of the unit block. For example, when the pressed surface of the unit block measures 300 mm×300 mm and the thickness of the packing member is 5 mm, the lateral length La of the pressed surface contact part 5 of the packing members 3*a*, 3*b* in FIG. 2 can be 290 mm at maximum. As understood from this example, the upper limit of 97% of the rate of each of the dimensions La and Lc of sides of the pressed surface contact part 5 to the dimension of each side of the pressed surface 2*a* of the unit block 2 mainly serves to prevent interference between the packing members of the adjacent unit blocks and therefore, depending on the thickness of the packing member, the rate may exceed 97%.

It is preferred that the heated surface protection part 6 as the movable part of each of the packing members 3*a*, 3*b* shown in FIGS. 2(*a*) and 2(*b*) is sized such that end of each of the packing members 3*a*, 3*b* is located between adjacent folds so that the ends is not in contact with the fold of the CF blanket stacked and compressed in the unit block 2 (FIG. 1). Further, it is necessary to ensure a region for the eyelet holes as the handhold parts 10 in the heated surface protection part 6. For this reason, for example, in the case of using the CF blanket having a thickness of 25 mm, it is preferred that the dimension Lb of the heated surface protection part 6 is in the range from 56 to 94 mm.

In the case of using a below-mentioned pulling jig for the packing material, to prevent lowering of the workability of the pulling jig and make the packing member strong enough for repeated use, the eyelet holes provided as the handhold parts 10 preferably have a diameter of 10 to 30 mm, and more preferably about 15 mm. By providing the eyelet holes at two places of the heated surface protection part 6, the pulling direction of the packing members 3*a*, 3*b* can be stably fixed to a direction vertical to the aligned surface of the unit blocks 2 (heated furnace-surface). In consideration of positions of action point and fulcrum, which are loaded in the pulling-out operation of the packing members 3*a*, 3*b*, for example, with the unit block measuring 300 mm×300 mm×300 mm, the eyelet holes 10 each is provided such that a length $l_1$ from the center of the eyelet hole 10 to the free end of the heated surface protection part 6 in FIG. 2 is preferably in the range of from 10 to 30 mm, and more preferably about 20 mm, and a length $l_2$ between the centers of the eyelet holes 10 is preferably in the range of from 50 to 200 mm, and more preferably about 100 mm.

The packing material 3 can be made of any material allowing the heated surface protection part 6 movable relative to the pressed surface contact part 5 to be provided. Example of possible materials include synthetic resin materials typified by thermoplastic resins such as hard polyvinyl chloride, polypropylene, polycarbonate, polyethylene terephthalate, polyethylene, and thermosetting resins such as phenol resins, epoxy resins, unsaturated polyester, as well as ABS resins, and polyamide. Preferably, a reusable synthetic resin sheet or a corrugated plastic cardboard made of hard polyvinyl chloride, polypropylene, polycarbonate, polystyrene or the like is used. It is more preferred that the synthetic resin that forms the synthetic resin sheet or the corrugated plastic cardboard can be recycled and reused. For collection and reuse after lining of the heated furnace-surface, it is preferred that such a plastic packing material has a thickness in the range of from 2 to 10 mm, and more preferably from 4 to 6 mm, and has a weight per unit area in the range of from 500 to 10,000 g/m$^2$, and more preferably from 1,000 to 5,000 g/m$^2$.

Figure 10:
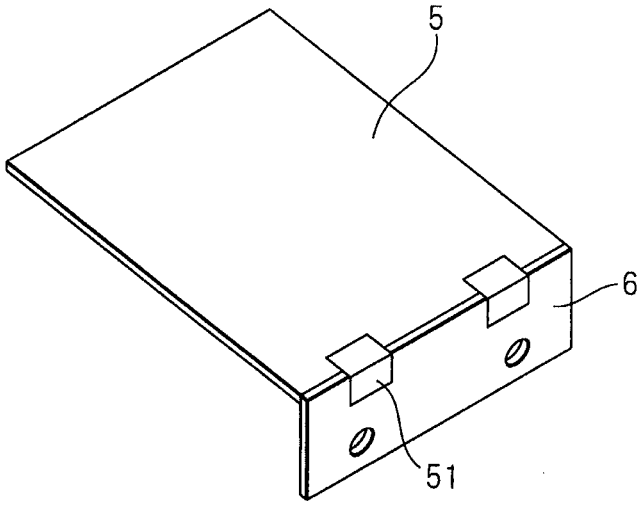
FIG. 10 is a view illustrating the pressed surface contact part 5 and the heated surface protection part 6, in which FIG. 10(*a*) shows the pressed surface contact part 5 coupled to the heated surface protection part 6 with hinges 51, and FIG. 10(*b*) shows the pressed surface contact part 5 coupled to the heated surface protection part 6 with a sheet member 52.
Figure 10:
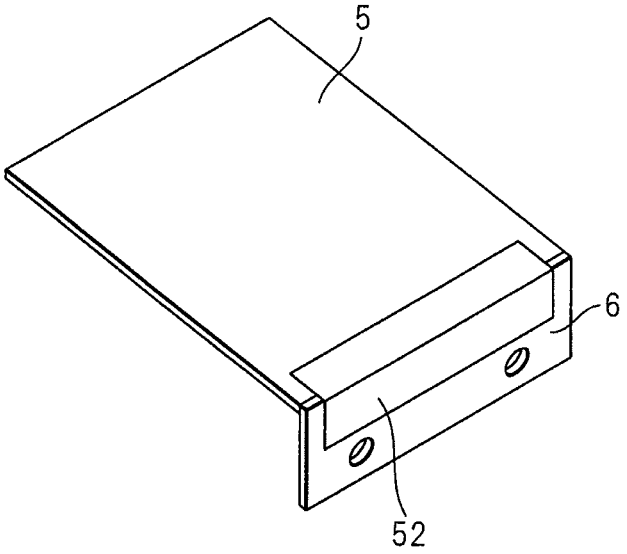

Since the plurality of fibrous heat-insulating blocks 1 are arranged at the predetermined place at lining application, the packing material 3 is sandwiched between the adjacent unit blocks 2. The packing material 3 is then pulled out from between the adjacent unit blocks 2 by removing the binding bands 4. To simplify the pulling-out operation of the packing material 3, it is preferred that when the binding bands are removed, the pair of packing members 3*a*, 3*b* configuring the packing material 3 are separated from the heated surface protection part due to elasticity of the material itself forming the packing members 3*a*, 3*b*. In order to make the heated surface protection part 6 bend at the boundary 7 movable relative to the pressed surface contact part 5, for example, a notch along the boundary 7 may be made, if needed. In some cases, the pressed surface contact part 5 and the heated surface protection part 6 can be individually formed and are coupled to each other with hinges 51 (FIG. 10(*a*)) or a sheet member 52 (FIG. 10(*b*)) connected to both the pressed surface contact part 5 and the heated surface protection part 6 (for example, with an adhesive) to assemble the packing member, which would take much time and effort.

In lining with the fibrous heat-insulating block according to the present invention, after the fibrous heat-insulating blocks are arranged at the predetermined places of the heated furnace-surface and the binding bands are removed, the compressed CF blankets of the unit blocks attempt to restore in the stacking direction. By using this restoring force, the adjacent blocks are put into close contact with each other. For this reason, after removal of the binding bands, the packing member is sandwiched between the adjacent blocks with the strong force and remains. For collection and reuse, the packing member sandwiched between the adjacent blocks needs to be pulled out without being broken or deformed. Thus, the packing material needs to have an appropriate strength and appropriate slip property. These properties depend on various factors including the size of the block, the type of the fibrous heat-insulating material, the material for the packing member. As an example, in the case where a plastic packing member as exemplified above is pulled out from between the fibrous heat-insulating blocks using the unit block of 300×300×300 mm, which is formed by stacking 16 folded layers of the CF blanket having a thickness of 25 mm, it is preferred that the packing member has a tensile strength of 10 MPa or higher, and a static friction coefficient with the CF blanket of 1.0 or smaller. When the tensile strength is less than 10 MPa, the packing material breaks when being pulled out from between the fibrous heat-insulating blocks attached to the heated furnace-surface, and remains between the blocks, which requires the excessive operation of removing the remaining packing material and disables reuse of the packing material. Also when the packing material does not break but is deformed, the packing material cannot be disadvantageously reused. On the other hand, when the tensile strength is more than 70 MPa, a larger advantage cannot be obtained from a practical standpoint. When the static friction coefficient with the CF blanket is more than 1.0, it takes a long time to pull out the packing material from between the fibrous heat-insulating blocks, or some packing material cannot be pulled out. When the static friction coefficient is less than 0.1, a larger advantage cannot be obtained. More preferably, the tensile strength of the packing member is in the range of from 10 to 70 MPa, and the static friction coefficient with the CF blanket is in the range of from 0.25 to 0.9.

Figure 9:
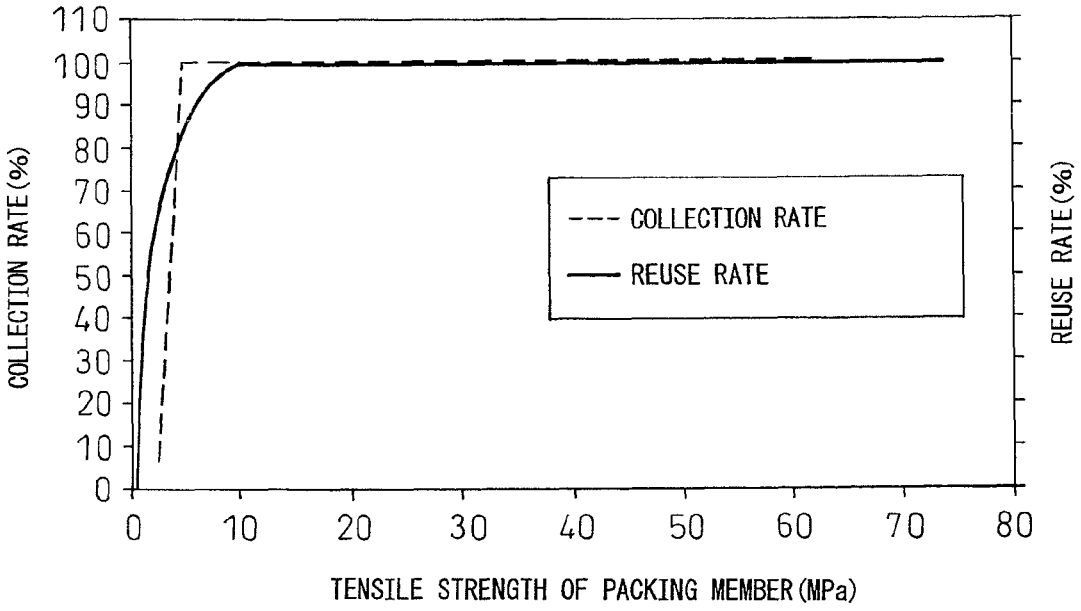
FIG. 9 is a graph showing relationship between the tensile strength of the packing material and a collection rate at pulling-out of the packing material from between the adjacent blocks, as well as relationship between the tensile strength and a reuse rate.

The static friction coefficient with the CF blanket, which is required for the packing member, does not depend on the size of the unit block. On the contrary, the tensile strength required for the packing member depends on the size of the unit block. Specifically, as the contact area between the adjacent blocks is larger, a larger tensile strength is required. As an example, with the unit block of 300×300×300 mm as referred to above, relationship between the tensile strength of the packing member and a collection rate at pulling-out of the packing member from between the adjacent unit blocks becomes as shown in FIG. 9. The collection rate of the packing member (the rate of the packing member collected without remaining between the unit blocks) is 100% when the tensile strength is 5 MPa or higher, but a part of the collected packing member can be deformed and the deformed packing member cannot be reused. As apparent from the data on the reuse rate in FIG. 9 (the rate of the packing material pulled out without being broken nor deformed), all of the collected packing material can be reused when the tensile strength is 10 MPa or higher.

Generally, with a cube or rectangular parallelepiped-shaped unit block having each side of about 200 to 400 mm, which is preferred in terms of handleability and workability, the tensile strength of the packing member is preferably from 5 to 90 MPa, and more preferably from 10 to 70 MPa. Although depending on the type of the fibrous heat-insulating material used, the static friction coefficient of the packing member with the fibrous heat-insulating blanket is preferably from 0.1 to 1, and more preferably from 0.25 to 0.9.

The above-mentioned plastic packing member can generally satisfy these conditions. Therefore, such a plastic packing member can be used in the fibrous heat-insulating block according to the present invention without requiring excessive processing such as application of a lubricant on the surface.

In the conventional fibrous heat-insulating block, there has been mainstream to use a paper cardboard or a linden plywood having a thickness of about 2 to 6 mm as the packing material. With the packing material formed of the cardboard, since the tensile strength of a liner and a core of the cardboard is about 10 to 50 kPa, the packing material often breaks due to lack in strength when being pulled out from between the adjacent blocks. With the packing material formed of linden plywood, since the static friction coefficient with the CF blanket is about 2.0, it is difficult to pull out the packing material from between adjacent blocks due to the low slip property.

Figure 8:
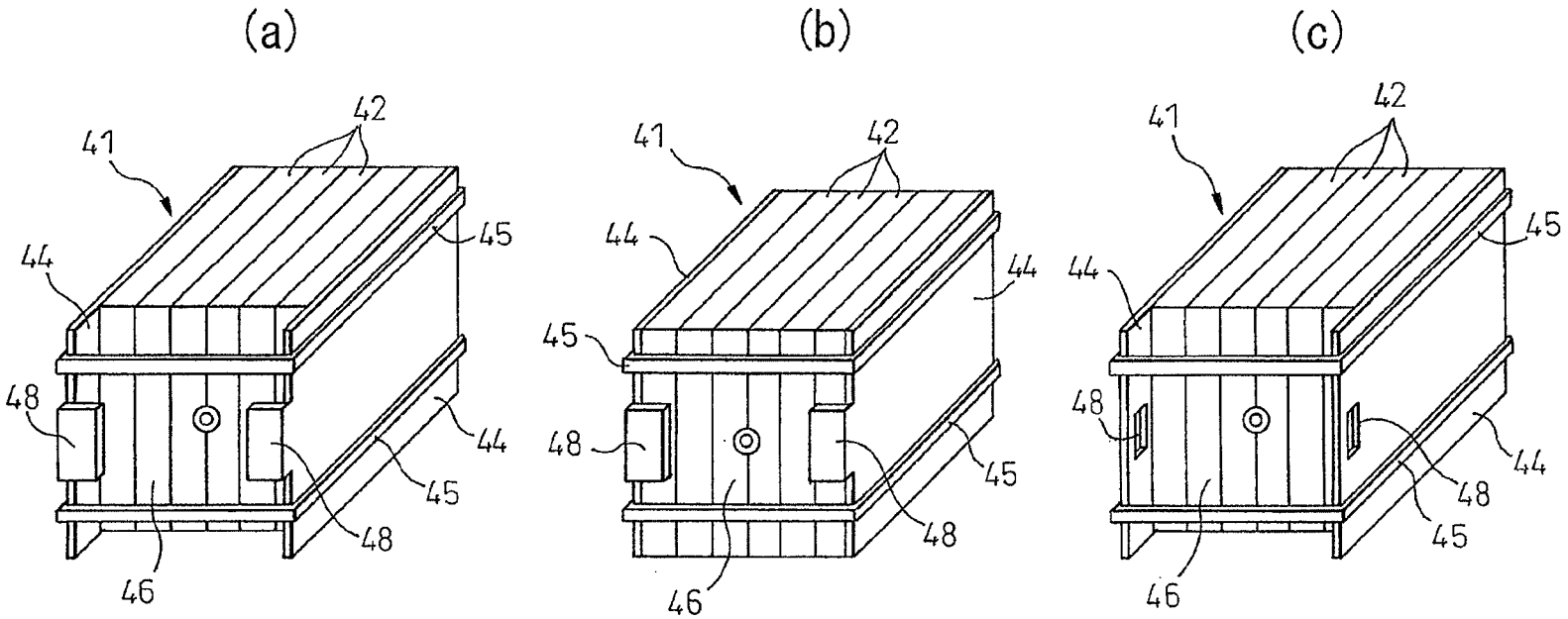
FIG. 8 is a view illustrating a compression module using a CF blanket disclosed in Patent Literatures 3, in which FIG. 8(*a*) shows the compression module using fish plates having a part protruded from a heated surface of the module and a handhold part formed by bending inward a part of the protruded part, FIG. 8(*b*) shows the compression module including handhold parts formed by partially bending their ends corresponding to the heated surface of the module toward the heated surface, and FIG. 8(*c*) shows the compression module including parts protruded from the heated surface of the module and a hole formed in the protruded part, the hole being used as a handhold part.

In the packing material made of the rigid material as described in Patent Literatures 3 (see FIGS. 8(*a*) and 8(*c*)), braking and deformation caused by pulling-out are prevented. However, with the unit block shown in FIGS. 8(*a*) and 8(*c*), since a part of the packing material 44 is protruded from the heated surface 46 of the block 41, the dimensional accuracy of the block 41 may be lowered by excessively fastening the side of the heated surface 46 of the block 41 at binding with the bands 45. Moreover, since the heated surface 46 of the module 41 is not protected at all, the heated surface 46 may be damaged during storage, transportation, lining and the like. With the unit block in FIG. 8(*b*), although local excessive fastening with the bands 45 is avoided, when the packing material 44 is pulled out, it is necessary to insert any tool between the heated surface 46 of the block 41 and the handhold part 48 of the packing material 44, which can easily damage the heated surface 46. Moreover, since heated surface 46 is exposed except for the handhold part 48, the corners of the unit block can be easily damaged especially at binding with the bands 45. Even when, for example, a hook is added to the handhold part 48 in FIG. 8(*b*), smooth pulling-out cannot be achieved unless the direction of applying a force to the hook at pulling-out is made equal to the direction of pulling out the packing material 44, which lowers the workability.

In the fibrous heat-insulating block 1 according to the present invention in FIGS. 1(*a*) and 1(*b*), the binding band 4 that binds the unit block 2 together with the packing material 3 can be made of any material that has a strength necessary for binding, and can be easily cut in pulling out the packing material 3 from between the blocks having been arranged side-by-side at lining application. The material for the binding band 4 is not specifically limited, but may be polypropylene or the like.

The present invention also provides a heated furnace-surface lining method using the fibrous heat-insulating block according to the present invention. According to the method, a plurality of fibrous heat-insulating blacks are arranged at predetermined places of the heated furnace-surface, the plurality of fibrous heat-insulating blocks each including:

a unit block formed by stacking layers of fibrous heat-insulating blanket under pressure, the unit block being used as a unit for lining, a packing material including pressed surface contact parts covering at least a part of each of pressed surfaces as side surfaces of the unit block in a blanket stacking direction, and heated surface protection parts covering a heated surface of the fibrous heat-insulating block heated in the state where a furnace is lined therewith, and a binding band keeping the shape of the unit block via the packing material, and after cutting and removal of the binding band of the fibrous heat-insulating block, the packing material remaining between the adjacent fibrous heat-insulating blocks are pulled out, thereby putting the adjacent fibrous heat-insulating blocks into close contact with each other, the method being characterized in that, as the fibrous heat-insulating block, the fibrous heat-insulating block according to the present invention is used.

The method of arranging the plurality of fibrous heat-insulating blocks at predetermined places of the heated furnace-surface is not specifically limited, and a checker method, a soldier method or the like can be adopted.

Figure 4:
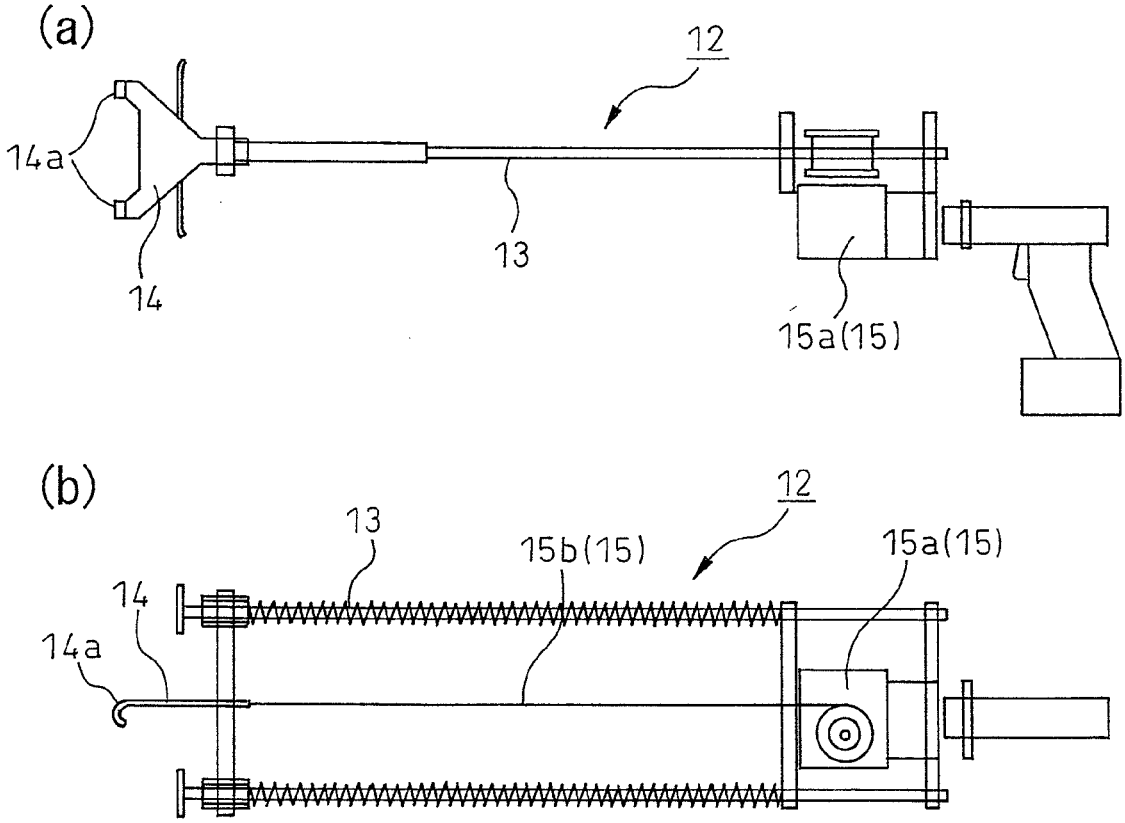
FIG. 4 is a view showing a pulling jig used when pulling out the packing material from between the adjacent blocks in lining using the fibrous heat-insulating block according to the present invention, in which FIG. 4(*a*) is a side view of the pulling jig, and FIG. 4(*b*) is a front view of the pulling jig.

The packing material remaining between the adjacent fibrous heat-insulating blocks may be manually pulled out, or may be pulled out by use of a packing material pulling jig as illustrated in FIGS. 4(*a*) and 4(*b*). The pulling jig 12 in FIGS. 4(*a*) and 4(*b*) includes a leg 13 that has one end in contact with the unit block 2 (FIGS. 1(*a*) and 1(*b*)) substantially vertically thereto, a movable part 14 that includes a pair of hooks 14*a* detachably engaged with the eyelet holes 10 (FIGS. 1(*a*) and 1(*b*)) of the handhold part provided in each of the packing members 3*a*, 3*b* of the packing material 3, and moves along the leg 13 nearer to or away from the unit block 2, and an electric reeler (towing means) 15 that is provided at the other end of the leg 13, and has a motor (driving means) 15*a* and a towing wire 15*b* that move the movable part 14 along the leg 13.

Figure 5:
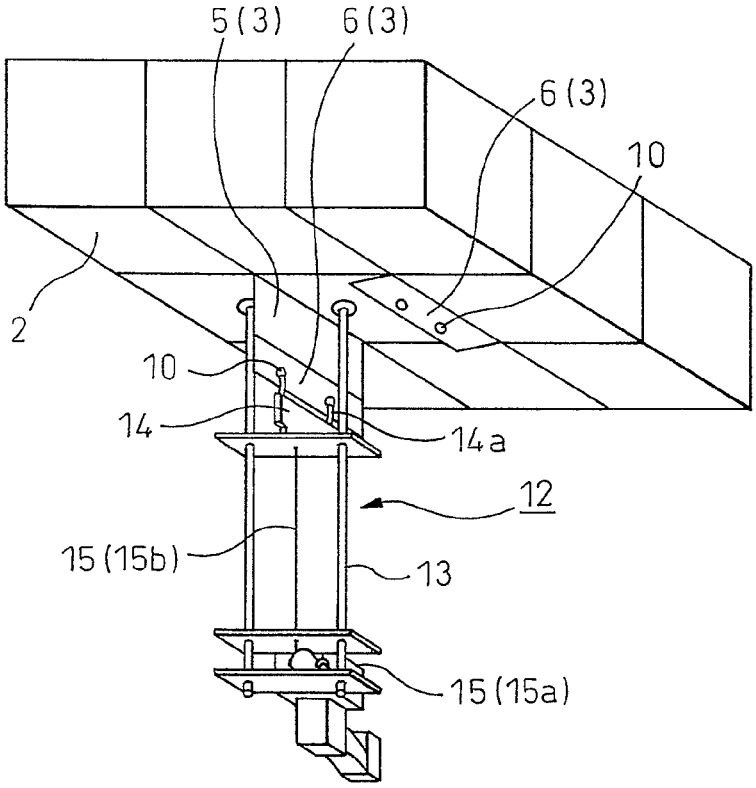
FIG. 5 is a view illustrating the pulling-out operation of the packing material by use of the pulling jig in FIG. 4.

When the packing material is pulled out from between the adjacent fibrous heat-insulating blocks provided on the heated furnace-surface (for example, a ceiling surface) by lining application by use of the pulling jig 12 in FIGS. 4(*a*) and 4(*b*), the packing material 3 may be pulled out by putting the hooks 14*a* of the movable part 14 of the pulling jig 12 on the eyelet holes 10 provided in the heated surface protection part 6 of the packing material 3 released by removal of the binding band, as shown in FIG. 5, putting the leg 13 into contact with the unit block 2 and driving the reeler 15 to pull the packing material 3. Use of this pulling jig 12 can greatly reduce time necessary for the pulling-out operation of the packing material.

Figure 6:
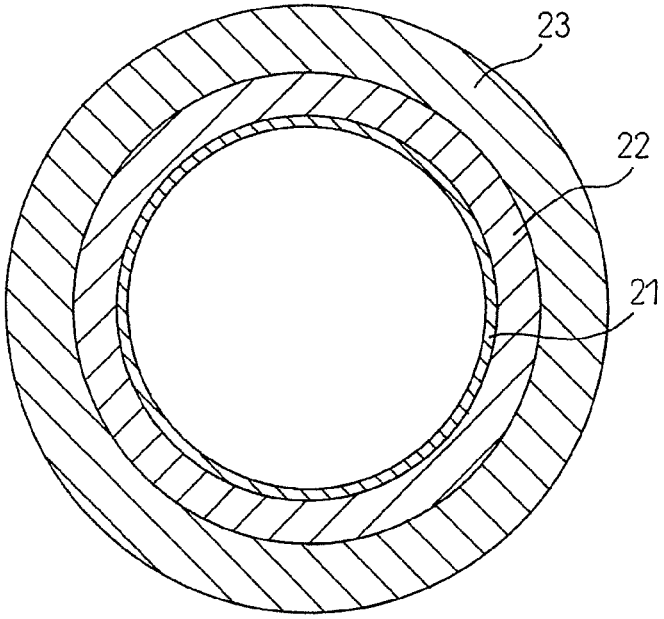
FIG. 6 is a view showing a lining layer formed of the fibrous heat-insulating block according to the present invention applied to a skid post.

The fibrous heat-insulating block according to the present invention can be used in heat-insulating treatment of a region (heated furnace-surface) where it is not in contact with a scale or melted metal in the heating furnace or the like. Examples of the heated furnace-surface to which the fibrous heat-insulating block of the present invention can be applied may include the ceiling surface described with reference to FIGS. 4(*a*) and 4(*b*), a partition wall, and a surface of a skid post. FIG. 6 illustrates the fibrous heat-insulating block of the present invention applied to a skid post 21. A lining layer 23 formed by arranging the fibrous heat-insulating blocks of the present invention surrounds a castable layer 22 formed around the skid post 21. As a matter of course, the lining layer 23 is formed by assembling a lot of blocks, but FIG. 6 does not show individual blocks for simplicity.

EXAMPLES

The present invention will be described in more detail based on examples and comparative examples.

In the following examples and comparative examples, the tensile strength and the static friction coefficient with the CF blanket for a material for each packing member were measured as follows.

[Measurement of Tensile Strength of Material for Packing Member]

The material tensile strength of the packing member was measured based on JIS K 7113 by use of a universal tester. With the packing member made of a corrugated plastic cardboard, the tensile yield strength of a synthetic resin sheet thereof was measured, and with the packing member made of cardboard, the tensile yield strength of the liner thereof was measured. A tensile strength of a paper material such as a liner is generally represented by stress per unit width. However, to compare with values for synthetic resin sheets and linden plywoods, the thickness of the liner was measured and the measured value was converted into a stress per sectional area.

[Measurement of Static Friction Coefficient with CF Blanket of Packing Material]

The static friction coefficient with the CF blanket was measured according to a gradient method of JIS P 8147 by attaching the packing member to a tilt table, placing the CF blanket as a test piece thereon and measuring an gradient angle at which the packing member starts to slip.

Example 1

First, a plate piece measuring 290 mm in width×590 mm in length was cut from a polypropylene corrugated plastic cardboard (marketed product: brand name "SUNPLY" manufactured by Sumika Plastics) having a thickness of 6 mm, a weight per unit area of 1,600 g/m$^2$, a material tensile strength of 30 MPa, and a static friction coefficient with the CF blanket of 0.38. By press molding in which heating and pressing are applied, the plate piece was sectioned into a pressed surface contact part and a heated surface protection part at a position away from one longitudinal edge by 76 mm, and the boundary between them was formed such that the heated surface protection part could be bent relative to the heated surface contact part by 90 degrees at maximum. Also, two aluminum eyelets (inner diameter of 15 mm) were provided at positions where the distance $l_1$ (FIG. 2(*a*)) from the free end of the heated surface protection part is 20 mm, and the distance $l_2$ (FIG. 2(*a*)) between the centers is 150 mm to form a packing member. A set of the two packing members thus formed were used as a packing material for a unit block.

Next, a band-like CF blanket (SC blanket 1260 manufactured by Shin-Nippon Thermal Ceramics Corporation) measuring 25 mm in thickness×4,800 mm in width was alternately folded every 300 mm into 16 layers and then, a pair of packing members were placed on the surfaces (pressed surfaces) of the layered CF blanket. The CF blanket was compressed in the layered direction thereof via the packing members and then, was bound with binding bands to form a unit block measuring 300 mm×300 mm×300 mm.

A ceiling surface measuring 1.8 m×2.4 m in a hot-rolling heating furnace of a steel plant was lined with 48 fibrous heat-insulating blocks thus prepared according to the block arrangement of a checker method. At this time, pulling-out operation of the packing material was performed as shown in FIG. 5 by use of a pulling jig for the packing material as shown in FIG. 4. In the pulling-out operation of the packing materials, time taken for the pulling-out operation (minute/m$^2$) was measured, and collection rate of the packing members collected without remaining between the unit blocks after the lining application was obtained. Further, in the case where all packing materials were collected, the degree of breaking or deformation of each collected packing material was observed to examine the possibility of repeated use.

The results are shown in Table 1.

Example 2

Packing materials were manufactured in the same manner as in Example 1 except that a hard polyvinyl chloride sheet (a generic product belonging to Group 1 of JIS K 6745) having a thickness of 5 mm, a weight per unit area of 7,000 g/m$^2$, a material tensile strength of 50 MPa, and a static friction coefficient with the CF blanket of 0.39 was used as a material for the packing materials (each consisting of a pair of packing members). Further, the ceiling surface of the furnace wall was lined in the same manner as in Example 1 according to the checker method. In the pulling-out operation of the packing materials, time taken for the pulling-out operation (minute/m$^2$), collection rate of the packing members that could be collected from between the unit blocks after lining application, and possibility of repeated use of the collected packing members were examined.

The results are shown in Table 1.

Example 3

Manufacturing and lining application of packing materials (each consisting of a pair of packing members) were performed in the same manner as in Example 1, except that the block arrangement was changed to a soldier method in lining application of fibrous heat-insulating blocks on the ceiling surface of the furnace wall. In the pulling-out operation of the packing materials, time taken for the pulling-out operation (minute/m$^2$), collection rate of the packing members that could be collected from between the unit blocks after lining application, and possibility of repeated use of the collected packing members were examined.

The results are shown in Table 1.

Example 4

Manufacturing and lining application of packing materials (each consisting of a pair of packing members) were performed in the same manner as in Example 1, except that in the pulling-out operation of the packing materials, a pulling rod having a hook at its front end was used in place of the pulling jig. In the pulling-out operation of the packing materials, time taken for the pulling-out operation (minute/$m^2$), collection rate of the packing members that could be collected from between the unit blocks after lining application, and possibility of repeated use of the collected packing members were examined.

The results are shown in Table 1.

Example 5

Packing materials were manufactured in the same manner as in Example 1, except that a soft polyvinyl chloride sheet having a thickness of 5 mm, a weight per unit area of 6,750 g/$m^2$, a material tensile strength of 15 MPa, and a static friction coefficient with the CF blanket of 0.80 was used as a material for the packing materials (each consisting of a pair of packing members). Further, the ceiling surface of the furnace wall was lined in the same manner as in Example 1 according to the checker method. In the pulling-out operation of the packing materials (using the pulling rod used in Example 4), time taken for the pulling-out operation (minute/$m^2$), collection rate of the packing members that could be collected from between the unit blocks after lining application, and possibility of repeated use of the collected packing members were examined.

The results are shown in Table 1.

Example 6

Packing materials were manufactured in the same manner as in Example 1, except that a polycarbonate sheet having a thickness of 5 mm, a weight per unit area of 6,000 g/$m^2$, a material tensile strength of 67 MPa, and a static friction coefficient with the CF blanket of 0.25 was used as a material for the packing materials (each consisting of a pair of packing members). Further, the ceiling surface of the furnace wall was lined in the same manner as in Example 1 according to the checker method. In the pulling-out operation of the packing materials (using the pulling rod used in Example 4), time taken for the pulling-out operation (minute/$m^2$), collection rate of the packing members that could be collected from between the unit blocks after lining application, and possibility of repeated use of the collected packing members were examined.

The results are shown in Table 1.

Example 7

Packing materials were manufactured in the same manner as in Example 1, except that a polystyrene sheet having a thickness of 5 mm, a weight per unit area of 5,500 g/$m^2$, a material tensile strength of 75 MPa, and a static friction coefficient with the CF blanket of 0.25 was used as a material for the packing materials (each consisting of a pair of packing members). Further, the ceiling surface of the furnace wall was lined in the same manner as in Example 1 according to the checker method. In the pulling-out operation of the packing materials (using the pulling rod used in Example 4), time taken for the pulling-out operation (minute/$m^2$), collection rate of the packing members that could be collected from between the unit blocks after lining application, and possibility of repeated use of the collected packing members were examined.

The results are shown in Table 1.

Comparative Example 1

Manufacturing and lining application of packing materials (each consisting of a pair of packing members) were performed in the same manner as in Example 1, except that a paper cardboard having a thickness of 5 mm, a weight per unit area of 950 g/$m^2$, a material tensile strength of 0.05 MPa, and a static friction coefficient with the CF blanket of 0.73 was used, and no eyelet hole was provided. In pulling-out operation of the packing materials (using the pulling rod used in Example 4), time taken for the pulling-out operation (minute/$m^2$), collection rate of the packing members that could be collected from between the unit blocks after lining application, and possibility of repeated use of the collected packing members were examined.

The results are shown in Table 1.

Comparative Example 2

Manufacturing and lining application of packing materials (each consisting of a pair of packing members) were performed in the same manner as in Example 1 except that a linden plywood having a thickness of 6 mm, a weight per unit area of 3,000 g/$m^2$, and a static friction coefficient with the CF blanket of 1.96 was used, and no eyelet hole was provided. In pulling-out operation of the packing materials (using the pulling rod used in Example 4), time taken for the pulling-out operation (minute/$m^2$), collection rate of the packing members that could be collected from between the unit blocks after lining application, and possibility of repeated use of the collected packing members were examined. The tensile strength of the plywood exceeded a measurement limit.

The results are shown in Table 1.

Comparative Example 3

Manufacturing and lining application of packing materials (each consisting of a pair of packing members) were performed in the same manner as in Example 1 except that a hard polyvinyl chloride sheet having a thickness of 5 mm, a weight per unit area of 7,000 g/$m^2$, a material tensile strength of 50 MPa, and a surface subjected to an abrasive treatment to provide a static friction coefficient with the CF blanket of 1.20, and no eyelet hole was provided. In pulling-out operation of the packing materials (using the pulling rod used in Example 4), time taken for the pulling-out operation (minute/$m^2$), collection rate of the packing members that could be collected from between the unit blocks after lining application, and possibility of repeated use of the collected packing members were examined.

The results are shown in Table 1.

Comparative Example 4

Manufacturing and lining application of packing materials (each consisting of a pair of packing members) were performed in the same manner as in Example 1, except that a soft polyvinyl chloride sheet having a thickness of 5 mm, a weight per unit area of 5,500 g/m$^2$, a material tensile strength of 5 MPa, and a static friction coefficient with the CF blanket of 0.80 was used, and no eyelet hole is provided. In pulling-out operation of the packing materials (using the pulling rod used in Example 4), time taken for the pulling-out operation (minute/m$^2$), collection rate of the packing members that could be collected from between the unit blocks after lining application, and possibility of repeated use of the collected packing members were examined.

The results are shown in Table 1.

TABLE 1

| | | Examples | | | | | | |
|---|---|---|---|---|---|---|---|---|
| | | 1 | 2 | 3 | 4 | 5 | 6 | 7 |
| Packing members | Used materials | A | B | A | A | C | D | E |
| | Material tensile strength (MPa) | 30 | 50 | 30 | 30 | 15 | 67 | 75 |
| | Static friction coefficient | 0.38 | 0.39 | 0.38 | 0.38 | 0.80 | 0.25 | 0.25 |
| Block arrangement | | checker | checker | *1) | checker | checker | checker | checker |
| Use of pulling jig | | Yes | Yes | Yes | No | No | No | No |
| Pulling-out operation of packing members | Required time (minute/m$^2$) | 9 | 12 | 9 | 20 | 22 | 20 | 20 |
| | Collection rate (%) | 100 | 100 | 100 | 100 | 100 | 100 | 100 |
| | Possibility of repeated use | Yes | Yes | Yes | Yes | Yes | Yes | Yes |

| | | Comparative Examples | | | |
|---|---|---|---|---|---|
| | | 1 | 2 | 3 | 4 |
| Packing members | Used material | F | G | B' | C' |
| | Material tensile strength (MPa) | 0.05 | — | 50 | 5 |
| | Static friction coefficient | 0.73 | 1.96 | 1.20 | 0.80 |
| Block arrangement | | checker | checker | checker | checker |
| Use of pulling member | | No | No | No | No |
| Pulling-out operation of packing members | Required time (minutes/m$^2$) | 25 | 40 | 38 | 30 |
| | Collection rate (%) | 50 | 20 | 90 | 90 |
| | Possibility of repeated use | No | No | No | No |

(Note)
A: Corrugated plastic cardboard made of polypropylene
B: Hard polyvinyl chloride sheet
B': Hard polyvinyl chloride sheet having a surface subjected to an abrasive treatment
C and C': Soft polyvinyl chloride sheet having a weight per unit area of 6,750 and 5,500 g/m$^2$
D: Polycarbonate sheet
E: Polystyrene sheet
F: Cardboard made of paper
G: Plywood made of Linden
*1): Soldier method As apparent from the results shown in Table 1, in the case of using the packing material made of a conventional paper cardboard (Comparative Example 1), since the tensile strength was low, breaking occurred in the pulling-out operation, and the collection rate was limited to 50%. In the case of using the packing material made of the linden plywood (Comparative Example 2), since the static friction coefficient was high, many of packing members could not be pulled out, in the pulling-out operation, from between the unit blocks after lining application, resulting in the collection rate of 20%. In the case of using the packing material made of the soft polyvinyl chloride sheet having the tensile strength of 5 MPa (Comparative Example 4), the packing members after operation were deformed. In the case of using the hard polyvinyl chloride sheet having the surface subjected to an abrasive treatment and having the static friction coefficient with the CF blanket of 1.2 (Comparative Example 3), some packing members could not been pulled out between the unit blocks.

On the contrary, in Examples using the packing materials according to the present invention, the collection rates in the pulling-out operation of the packing materials were 100%, and the time taken for the pulling-out operation was greatly decreased as compared to Comparative Examples.

As apparent from comparison between Examples 4 to 7 and Comparative Examples 1 to 4, even with the manual operation using the same pulling rod, the time necessary for the pulling-out operation was substantially decreased in the Examples, and use of the pulling jig could remarkably decrease time necessary for the pulling-out operation.

Comparative Example 5

The packing materials described in Patent Literatures 3 as shown in FIG. 8(*a*) were made of a plastic sheet and an iron sheet, and evaluated in the same manner. As a result, dimensions of the heated surface 46 and the back surface of the block in the compressed direction were 270 mm and 300 mm, respectively and thus, the blocks had irregular shapes, resulting in that setting thereof at lining application took a long time. It was attempted to pull out the packing materials by holding the handhold part 48 with a nipper. The plastic sheet was damaged in the part held by the nipper, and the iron sheet was deformed, resulting in failure of pulling-out of some packing materials.

Comparative Example 6

The packing materials described in Patent Literatures 3 as shown in FIG. 8(*b*) were made of a plastic sheet and an iron sheet, and evaluated in the same manner. As a result, dimensions of the heated surface 46 and the back surface of the block in the compressed direction were almost the same. It was attempted to pull out the packing materials by use of a jig applied to the handhold part 48. In both cases of the plastic sheet and the iron sheet, the heated surface 46 was damaged when setting the jig at the handhold part. Further, since the area of the handhold part 48 was smaller than the area of the side surface 44 of the packing material, a large pulling force was required, which was a heavy physical work.

Comparative Example 7

The packing materials described in Patent Literatures 3 as shown in FIG. 8(*c*) were made of a plastic sheet and an iron sheet, and evaluated in the same manner. As a result, dimensions of the heated surface 46 and the back surface of the block in the compressed direction were 270 mm and 300 mm, respectively and thus, the blocks had irregular shapes, resulting in that setting thereof at lining application took a long time. It was attempted to pull out the packing materials by hanging a jig on the hole of the handhold part 48. In both cases of the plastic sheet and the iron sheet, the packing material could not been pulled out straight, and the collection rate was 70%.

DESCRIPTION OF REFERENCE NUMERALS

1: Fibrous heat-insulating block, 2: Unit block, 2*a*, 2*b*: Pressed surface, 2*c*: Heated surface, 3: Packing material, 3*a*,3*b*: Packing member, 4: Binding band, 5: Pressed surface contact part, 6: Heated surface protection part, 7: Boundary, 8: Fitting, 9: Guide pipe, 10: Handhold part (Eyelet hole), 11,11': Cut step, 12: Pulling jig, 13: Leg, 14: Movable part, 14*a*: Hook, 15: Reeler (Towing means), 15*a*: Motor (Driving means), 15*b*: Towing wire.

The invention claimed is:

1. A fibrous heat-insulating block used for lining a heated furnace-surface, the fibrous heat-insulating block comprising:

a unit block formed by folding a fibrous heat-insulating blanket alternately to form mountain folds and valley folds, and stacking layers of the fibrous heat-insulating blanket under pressure, the unit block being used as a unit for lining application;

a packing material including pressed surface contact parts each covering at least a part of each of pressed side surfaces of the unit block in a blanket stacking direction, and heated surface protection parts each being connected to the pressed surface contact parts and covering at least a part of a heated surface of the fibrous heat-insulating block heated in a state where a furnace is lined therewith, wherein a boundary between the pressed surface contact parts and the heated surface protection parts covers a corner formed by a pressed surface and a heated surface of the unit block; and a binding band keeping the shape of the unit block, wherein the heated surface protection parts of the packing material can be arranged on the same plane as the pressed surface contact parts after removing the binding band, and the heated surface protection parts of the packing material are provided with a handhold part, wherein the packing material comprises a pair of packing members arranged on the pressed side surfaces of the unit block in the blanket stacking direction, the packing members comprising the pressed surface contact parts, the heated surface protection parts connected thereto, and the boundary, wherein the packing material is made of a synthetic resin material, and has a thickness in a range of from 2 to 10 mm, and has a weight per unit area in a range of from 500 to 10,000 g/m$^2$, wherein a tensile strength of the packing members is not less than 10 MPa and not more than 70 MPa, wherein each dimension of respective sides of the pressed surface contact parts is not less than 85% and not more than 97% of a dimension of a side of the pressed surface of the unit block, wherein the unit block is a cube or rectangular parallelepiped having a side of 200 to 400 mm, and a static friction coefficient of each of the packing members with the fibrous heat-insulating blanket is 0.1 to 1, and wherein, after removal of the packing material, the unit block of the fibrous heat-insulating block is in close contact with adjacent unit blocks of adjacent fibrous heat-insulating blocks due to a restoring force of the folded fibrous heat-insulating blanket in the blanket stacking direction, without forming a gap of a triangular joint.

2. The fibrous heat-insulating block according to claim 1, wherein the packing member is bendable at the boundary.

3. The fibrous heat-insulating block according to claim 1, wherein the packing member is an integrated item, and has a notch along the boundary.

4. The fibrous heat-insulating block according to claim 1, wherein the pressed surface contact part and the heated surface protection part of the packing material are individually formed, and are connected to each other with a hinge or a sheet connected to the two.

5. The fibrous heat-insulating block according to claim 1, wherein the synthetic resin material is a sheet or corrugated plastic cardboard that is made of hard polyvinyl chloride, polypropylene, polycarbonate or polystyrene.

6. The fibrous heat-insulating block according to claim 1, wherein the handhold part is manufactured as an eyelet hole, a ring or a hook-like engaging part.

7. The fibrous heat-insulating block according to claim 1, wherein the heated surface protection part of each of the pair of packing members has a pair of the handhold parts.

8. An assembly comprising two or more fibrous heat-insulating blocks according to claim 1, wherein the fibrous heat-insulating blocks are arranged along a heated furnace-surface, and wherein after the binding bands and the packing members of the fibrous heat-insulating blocks are removed, adjacent unit blocks of the fibrous heat-insulating blocks are arranged without a gap of a triangular joint being formed and without the adjacent unit blocks being displaced from each other.

* * * * *